US006283655B1

(12) United States Patent
Thomas et al.

(10) Patent No.: US 6,283,655 B1
(45) Date of Patent: Sep. 4, 2001

(54) FRICTION-FEED PLOTTER WITH LATERALLY-MOVABLE DRIVE ROLLER, AND RELATED METHOD FOR PLOTTING ON SHEETS OF DIFFERENT WIDTHS

(75) Inventors: Michael J. Thomas, Hartford; Kenneth R. Fisher, Vernon, both of CT (US)

(73) Assignee: Gerber Scientific Products, Inc., Manchester, CT (US)

( * ) Notice: Subject to any disclaimer, the term of this patent is extended or adjusted under 35 U.S.C. 154(b) by 0 days.

(21) Appl. No.: 09/107,101

(22) Filed: Jun. 30, 1998

(51) Int. Cl.[7] ..... B41J 13/02

(52) U.S. Cl. ..... 400/634; 400/636; 400/637; 400/637.1; 400/639; 271/272; 271/273; 271/274

(58) Field of Search ..... 400/634, 636, 400/637, 637.1, 639, 641, 617; 271/272, 273, 274, 227, 228

(56) References Cited

U.S. PATENT DOCUMENTS

| | | | |
|---|---|---|---|
| 1,822,902 | | 9/1931 | Osborne . |
| 2,082,634 | | 6/1937 | Jonstone . |
| 2,220,736 | | 11/1940 | Stockbarger et al. . |
| 2,840,721 | | 6/1958 | Frommer . |
| 3,323,700 | | 6/1967 | Epstein . |
| 3,368,726 | | 2/1968 | Funk et al. . |
| 3,727,817 | | 4/1973 | Tibavido . |
| 3,761,950 | * | 9/1973 | Yeiser ..... 346/68 |
| 3,857,525 | | 12/1974 | Gerber et al. . |

(List continued on next page.)

FOREIGN PATENT DOCUMENTS

| | | |
|---|---|---|
| 195 11 682 | 10/1996 | (DE) . |
| 195 13 622 C2 | 10/1996 | (DE) . |
| 0 382 502 | 8/1990 | (EP) . |
| 0 485 167 A2 | 5/1992 | (EP) . |
| 0 501 604 | 9/1992 | (EP) . |

(List continued on next page.)

OTHER PUBLICATIONS

U.S. application No. 9/217,667, filed Dec. 21, 1998, in the name of Daren Yeo et al.

Kanno, T.; "Sheet–Rotating Mechanism", IBM Technical Disclosure Bulletin, vol. 25, No. 12, pp. 6656–6659 May 1983.

*Primary Examiner*—John S. Hilten
*Assistant Examiner*—Minh Chau
(74) *Attorney, Agent, or Firm*—McCormick, Paulding & Huber LLP

(57) ABSTRACT

In an apparatus and method for plotting on sheets of different widths, such as by cutting and/or printing, a tool support holding a plotting tool, such as a pen or knife blade, is spaced apart from a laterally-extending sheet-supporting surface and movable in the y-coordinate direction over the sheet-supporting surface for plotting on the sheet. A first drive roller defining an abrasive surface is rotatably mounted adjacent to the sheet-supporting surface for engaging a first marginal portion of the sheet and driving the sheet in the x-coordinate direction. A second rotatably-mounted drive roller is spaced laterally relative to the first drive roller, and defines an abrasive surface for engaging a second marginal portion of the sheet and further driving the sheet in the x-coordinate direction. A first drive motor is drivingly connected to the first drive roller for rotatably driving the first drive roller, and a second drive motor is drivingly connected to the second drive roller for rotatably driving the second drive roller. Both the second drive motor and second drive roller are laterally movable along an elongated track relative to the first drive roller, to thereby define any width between the first and second drive rollers within a predetermined range of widths.

26 Claims, 8 Drawing Sheets

U.S. PATENT DOCUMENTS

| | | | | |
|---|---|---|---|---|
| 4,216,482 | | 8/1980 | Mason . | |
| 4,262,894 | | 4/1981 | Marano | 271/4 |
| 4,291,825 | | 9/1981 | Glanz . | |
| 4,326,656 | | 4/1982 | Gregory et al. . | |
| 4,438,917 | * | 3/1984 | Janssen et al. | 271/227 |
| 4,485,982 | | 12/1984 | St. John et al. . | |
| 4,567,492 | | 1/1986 | Skafvenstedt et al. . | |
| 4,629,177 | | 12/1986 | Roddeman et al. . | |
| 4,683,480 | | 7/1987 | Sakamoto et al. | 346/134 |
| 4,697,694 | | 10/1987 | Huber | 198/782 |
| 4,734,716 | | 3/1988 | Silverberg et al. . | |
| 4,778,170 | | 10/1988 | Hynes | 271/253 |
| 4,824,090 | | 4/1989 | Booth, Sr. et al. | 271/3.1 |
| 4,839,674 | * | 6/1989 | Hanagata et al. | 271/227 X |
| 4,848,632 | | 7/1989 | Mack et al. . | |
| 4,903,045 | | 2/1990 | Sakamoto et al. | 346/136 |
| 4,959,040 | | 9/1990 | Gardner et al. . | |
| 5,000,032 | | 3/1991 | Nakashima et al. . | |
| 5,027,133 | | 6/1991 | Weiselfish . | |
| 5,060,926 | | 10/1991 | Murai et al. . | |
| 5,127,513 | | 7/1992 | Huber | 198/782 |
| 5,138,341 | * | 8/1992 | Kobayashi | 400/636 X |
| 5,163,675 | | 11/1992 | Sunohara . | |
| 5,169,140 | | 12/1992 | Wenthe, Jr. . | |
| 5,172,907 | | 12/1992 | Kalisiak . | |
| 5,215,184 | | 6/1993 | Huber | 198/782 |
| 5,289,206 | | 2/1994 | Ishikawa et al. . | |
| 5,289,788 | | 3/1994 | Fukumoto . | |
| 5,405,205 | | 4/1995 | Venthem et al. | 400/634 |
| 5,527,027 | | 6/1996 | Flade et al. . | |
| 5,549,291 | | 8/1996 | Devito | 271/3.03 |
| 5,645,361 | | 7/1997 | Mitsushima et al. | 400/636 |
| 5,672,020 | | 9/1997 | Leonard et al. . | |
| 5,678,159 | | 10/1997 | Williams et al. . | |
| 5,697,609 | | 12/1997 | Williams et al. . | |
| 5,711,470 | | 1/1998 | Thompson . | |
| 5,715,514 | | 2/1998 | Williams et al. . | |
| 5,887,996 | | 3/1999 | Castelli et al. . | |

FOREIGN PATENT DOCUMENTS

| | | |
|---|---|---|
| 0 512 827 | 9/1995 | (EP) . |
| 0 697 361 | 2/1996 | (EP) . |
| 0 814 040 | 12/1997 | (EP) . |
| 53-149412 | 12/1978 | (JP) . |
| 58-193181 | 11/1983 | (JP) . |
| 61-217457 | 9/1986 | (JP) . |
| 10075335 AA | 3/1989 | (JP) . |
| 3-264372 | 11/1991 | (JP) . |
| 6-103009 | 4/1994 | (JP) . |
| 8-53231 | 2/1996 | (JP) . |
| 9-188442 | 7/1997 | (JP) . |
| WO97/32730 | 9/1997 | (WO) . |

* cited by examiner

FRICTION-FEED PLOTTER WITH LATERALLY-MOVABLE DRIVE ROLLER, AND RELATED METHOD FOR PLOTTING ON SHEETS OF DIFFERENT WIDTHS

FIELD OF THE INVENTION

The present invention relates to apparatus and methods for plotting on sheets, and more particularly, to such apparatus and methods employing pinch rollers for pressing the sheets against abrasive drive rollers to frictionally engage and drive in their lengthwise direction sheets of different widths.

BACKGROUND OF THE INVENTION

A typical prior art friction-feed plotter employs a plurality of abrasive drive rollers mounted adjacent to a platen or like sheet-supporting surface. A plurality of pinch rollers are mounted above the drive rollers and movable into and out of engagement with a sheet material overlying the drive rollers. The pinch rollers press the sheet material into engagement with the abrasive drive rollers, and the abrasive drive rollers are rotatably driven to frictionally drive the sheet material in its lengthwise direction. A tool head comprising one or more plotting tools, such as a pen for drawing or printing lines or other graphic images on the sheet material, or a knife blade for cutting the sheet material, is mounted over the sheet-supporting surface and driven in the widthwise direction of the sheet material to plot by printing on and/or cutting the sheet material.

Friction-feed plotters of this type are employed for printing on and/or cutting numerous different types of sheet materials, such as vinyl and other types of polymeric sheets, paper and cardboard, and are used to make graphic products, such as signs, packaging and other visual displays. Commercially-available sheet materials are provided in various widths. In addition, a single piece of sheet material may be cut into any of an infinite number of different widths, thus leaving behind usable remnants or unused portions which likewise may be formed in any of an infinite number of different widths. For example, a relatively wide sheet may be initially used to print and cut a relatively narrow sign or other graphic product. Thus, a substantial amount of sheet may remain unused after the initial graphic product is prepared. Many of the sheet materials used for making signs, packaging and other visual displays are relatively expensive, and therefore it is desirable to minimize any waste by using the remnants or unused sheet portions to make additional graphic products. As a result, it is desirable for friction-feed plotters to handle sheets of virtually any width within a predetermined range of widths, in order to accommodate both the commercially-available sheet widths and any usable remnants or unused portions of such sheets.

Typical prior art plotters for accommodating sheet materials of different widths are shown in U.S. Pat. No. 5,163,675 to Sunohara ("the '675 patent"). One such prior art plotter employs a relatively long main drive roller mounted on one end of the sheet-supporting surface, and a relatively short sub-drive roller mounted on the opposite end of the sheet-supporting surface. A main pinch roller is mounted above, and movable laterally over the main drive roller for engaging the edge of a sheet overlying the main drive roller, and a sub-pinch roller is mounted above the sub-drive roller for engaging the edge of a sheet overlying the sub-drive roller. The main drive roller is sufficiently long so that the opposing edges of a sheet of any desired width within a premeditated range of widths may be engaged between the main and sub-drive rollers and the main and sub-pinch rollers, respectively.

The '675 patent states that the length of the main drive roller must be relatively great in order to accommodate the desired range of sheet widths. The '675 patent further states that the main drive roller must be capable of uniformly contacting and holding the sheet material without unequal contact pressures along its entire length. Accordingly, the '675 patent states that the main drive roller must be manufactured with very high precision, and therefore is unsuitable for mass production.

In order to overcome the problems associated with the above-described prior art plotter, the '675 patent teaches the use of a drive roller group consisting of a single relatively long main drive roller, and a three relatively short sub-drive rollers serially arranged at predetermined spacings from the main drive roller. A first pinch roller is mounted over the main drive roller and is movable laterally over the main drive roller, and a second pinch roller is mounted over the sub-drive rollers and is movable laterally over the sub-drive rollers for accommodating sheets of different widths. Although the main drive roller of the '675 patent is longer than each of the sub-drive rollers, the plurality of sub-drive rollers, and their predetermined spacings from the main drive roller, permit the main drive roller to be shorter than its counterpart in the above-described prior art plotter.

One of the drawbacks of the plotter illustrated in the '675 patent is that it still employs one relatively longer main drive roller in order to accommodate a sufficient range of sheet widths. Alternatively, if the longer main drive roller were eliminated, and the main and sub-drive rollers were of the same width, one or more additional sub-drive rollers would have to be added in order to accommodate the same range of sheet widths. The abrasive drive rollers employed in plotters of this type can be relatively expensive, however. Thus, the cost of the abrasive drive rollers in a plotter of this type can be substantially greater than in plotters employing a fewer number of such rollers.

Another problem encountered with prior art friction-feed plotters is that the sheet material may be unevenly driven by the abrasive drive rollers, and in turn assume a skewed or cocked position. This type of error is referred to as skew error. One approach for correcting skew error employed by the Assignee of the present invention is to independently drive the abrasive drive rollers engaging the opposing sides of the sheet material, and to provide at least one sensor for detecting any lateral deviation of the sheet material from its feed path. If a lateral deviation is detected, the abrasive drive rollers are controlled to rotate at different speeds to correct the lateral error.

The '675 patent teaches that the plurality of abrasive drive rollers should be rotated synchronously at the same peripheral speeds. In addition, the plotter of the '675 patent does not lend itself to driving the abrasive rollers independently of each other, or driving groups of the abrasive rollers independently of each other. Thus, the '675 patent does not explicitly recognize, nor does the plotter of this patent otherwise lend itself to correcting skew error.

Accordingly, it is an object of the present invention to provide friction-feed plotters which overcome one or more of the above-described drawbacks and disadvantages of the prior art.

SUMMARY OF THE INVENTION

The present invention is directed to an apparatus and method for plotting, such as by cutting and/or printing, on sheets of different widths. The apparatus comprises a sheet-supporting surface for supporting a sheet, and a tool support for holding a plotting tool, such as a pen or knife blade, which is spaced apart from the sheet-supporting surface and movable in a first coordinate direction relative to the sheet-supporting surface for plotting on the sheet. A first drive roller defining an abrasive surface is rotatably mounted on a first drive shaft adjacent to the sheet-supporting surface for engaging a first marginal portion of the sheet and driving the sheet in a second coordinate direction. A second drive roller is rotatably mounted on a second drive shaft spaced laterally relative to the first drive roller, and the second drive roller defines an abrasive surface for engaging a second marginal portion of the sheet and further driving the sheet in the second coordinate direction. At least one of the first and second drive rollers and their respective drive shafts are movable laterally relative to the other drive roller and shaft for engaging the first and second marginal portions of sheets of different widths.

A first pinch roller is mounted adjacent to the first drive roller, and is movable between an engaged position pressed into engagement with a sheet against the first drive roller, and a dis-engaged position spaced away from the first drive roller. A second pinch roller is mounted adjacent to the second drive roller, and likewise is movable between an engaged position pressed into engagement with a sheet against the second drive roller, and a dis-engaged position spaced away from the second drive roller. At least one of the first and second pinch rollers is movable laterally relative to the other for aligning itself with a respective drive roller and engaging sheets of different widths.

In a preferred embodiment of the invention, a first drive motor is drivingly connected to the first drive shaft for rotatably driving the first drive roller. A second drive motor is drivingly connected to the second drive shaft for rotatably driving the second drive roller, and the second drive motor is laterally movable with the second drive roller and shaft relative to the first drive roller.

One advantage of the apparatus and method of the present invention is that the second drive roller and second drive shaft are movable laterally relative to the first drive roller and first drive shaft to define any of an infinite number of sheet widths within a predetermined range of widths between the two drive rollers. Another advantage of the present invention is that because the first and second drive rollers are rotatably mounted on different first and second drive shafts, the first and second drive rollers may be driven at different rotational speeds relative to each other, and/or may be driven in different rotational directions relative to each other. Thus, in accordance with a preferred embodiment of the invention, the lateral position of the sheet may be detected, and the first and second drive rollers may be driven at different rotational speeds, and/or driven in different rotational directions relative to each other to correct skew error.

These and other advantages of the present invention will become more apparent in view of the following detailed description and accompanying drawings.

DETAILED DESCRIPTION OF THE PREFERRED EMBODIMENTS

Figure 1:
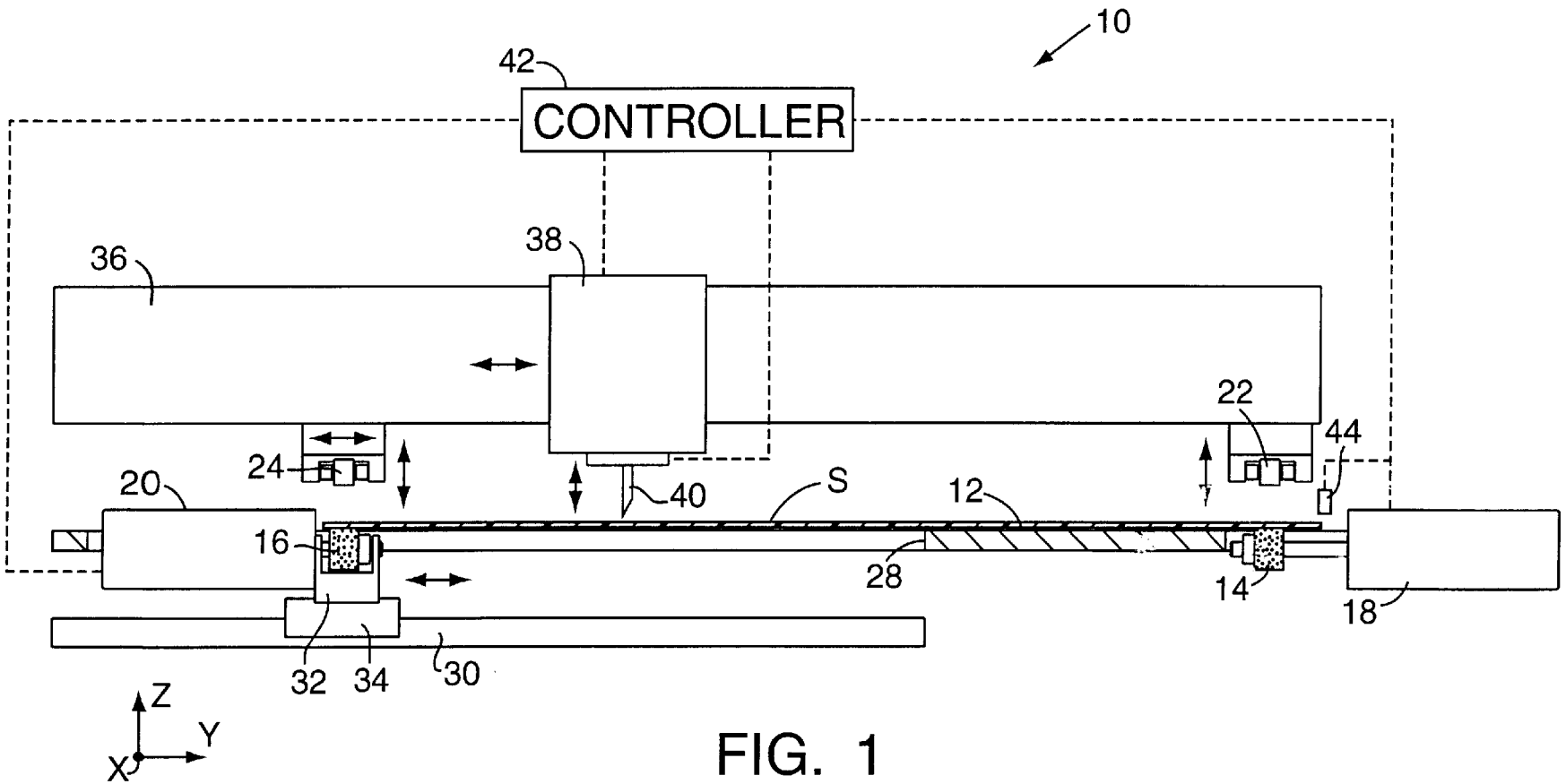
FIG. 1 is a schematic view of a first plotter embodying the invention employing a first drive roller and motor pair, and a second drive roller and motor pair, wherein one of the drive roller and motor pairs is movable laterally relative to the other for plotting on sheets of different widths.

In FIG. 1, an apparatus embodying the present invention for plotting on sheets of different widths is indicated generally by the reference numeral 10. The plotter 10 comprises a sheet-supporting surface 12 extending in the illustrated y-coordinate direction from approximately one side of the plotter to the other. A first drive roller 14 defining an abrasive peripheral surface is rotatably mounted on a first drive shaft at one end of the sheet-supporting surface 12 for frictionally engaging a first marginal portion or edge of a sheet S. A second drive roller 16 defining an abrasive peripheral surface is rotatably mounted on a second drive shaft spaced laterally on the sheet-supporting surface relative to the first drive roller for frictionally engaging a second marginal portion or edge of the sheet S.

The term "abrasive" is used herein to describe, without limitation, any of numerous different types of roughened surfaces defined by surface irregularities and/or protuberances for frictionally engaging and driving the sheets S. Accordingly, the means defining an abrasive surface for rotatably engaging the sheets and driving the sheets through the plotter may take the form of any of numerous different structures which are currently known, or later become commercially available or otherwise known for performing this function. For example, this means may take the form of the abrasive drive rollers described in U.S. Pat. Nos. 4,903,045 or 5,645,361, which are hereby expressly incorporated by reference as part of the present disclosure. The term "drive shaft" or "shaft" is used herein to describe, without limitation, a bar, pin, or other structure which may be used for rotatably supporting one or more of the drive rollers or like means on the plotter. The drive shafts, therefore, may take the form of any of numerous structures currently known, or which later become commercially available or otherwise known to those skilled in the pertinent art for performing this function.

A first drive motor 18 is drivingly connected to the first drive shaft to rotatably drive the first drive roller 14. A second drive motor 20 is drivingly connected to the second drive shaft to rotatably drive the second drive roller 16, and in turn drive the sheet S in its lengthwise direction (or the illustrated x-coordinate direction) over the sheet-supporting surface 12. These means for rotatably driving the drive rollers, and in turn driving the sheets through the plotter, may take the form of any of numerous different structures which now or later become commercially available or otherwise known for performing this function. For example, these means may take the form of any of numerous different known and/or commercially-available drive motors, such as electric servo or stepper motors.

A first pinch roller 22 is mounted over the first drive roller 14, and as indicated by the arrows in FIG. 1, is moveable in the illustrated z-coordinate direction between an engaged position pressed into engagement with a respective margin of the sheet S against the first drive roller 14, and a dis-engaged position spaced away from the first drive roller. A second pinch roller 24 is mounted over the second drive roller 16, and as indicated by the arrows in FIG. 1, is moveable in the illustrated z-coordinate direction between an engaged position pressed into engagement with a respective margin of the sheet S against the second drive roller 16, and a dis-engaged position spaced away from the second drive roller. Each of the pinch rollers 22 and 24 is biased downwardly against the sheet S and the corresponding drive roller 14 or 16 when located in its engaged position, and as described above, the abrasive drive rollers each define a roughened or abrasive peripheral surface for cooperating with the biased pinch rollers to frictionally engage the underside of the sheet S and rotatably drive the sheet. These means for pressing the sheets into engagement with the abrasive surfaces of the drive rollers to frictionally engage and drive the sheets, may take the form of any of numerous known and/or commercially-available pinch rollers or other structures for performing this function. In the preferred embodiment of the invention, the pinch rollers are formed of a relatively hard rubber or like polymeric material (approximately shore 90 durometer). However, as will be recognized by those skilled in the pertinent art based on the teachings herein, other rubber or polymeric materials, or other types of pinch rollers, may be equally employed.

In accordance with the present invention, at least one of the first drive roller 14 and first drive shaft, and second drive roller 16 and second drive shaft, is movable laterally (or in the illustrated y-coordinate direction) relative to the other drive roller and shaft to adjust the lateral spacing between the first and second drive rollers, and in turn engage the opposing marginal portions of sheets defining any width within a predetermined range of widths. Accordingly, in the preferred embodiment of the invention, an elongated aperture 28 is formed adjacent to the sheet-supporting surface 12 and extends in the illustrated y-coordinate direction adjacent to a substantial portion of the sheet-supporting surface. The plotter 10 further includes means extending in the y-coordinate direction for guiding the lateral movement of the second drive roller 16 relative to the first drive roller 14. In the currently-preferred embodiment, this means is in the form of a first elongated track or way 30 spaced below the sheet-supporting surface 12 and extending in the illustrated y-coordinate direction adjacent to the elongated aperture 28. The second drive roller 16 is mounted on a drive-roller carriage 32, and the drive-roller carriage is slidably mounted by a bearing assembly 34 to the elongated track 30. The second drive motor 20 is fixedly mounted to the drive-roller carriage 32, and is drivingly connected to the second drive roller 16 to rotatably drive the second drive roller on the carriage.

As also shown in FIG. 1, a second elongated track or way 36 is mounted above the sheet-supporting surface 12 and extends in the illustrated y-coordinate direction from approximately one end of sheet-supporting surface to the other. Each of the pinch rollers 22 and 24 is mounted on the second elongated track 36, and in furtherance of the invention, at least one of the first and second pinch rollers is movable laterally (or in the illustrated y-coordinate direction) relative to the other to adjust the lateral spacing between the first and second pairs of pinch and drive rollers, and in turn engage the opposing marginal portions of sheets defining any width within a predetermined range of widths. In the preferred embodiment of the invention, and as indicated by the arrows in FIG. 1, at least the second pinch roller 24 is movable laterally along the second track 36 to align the second pinch roller with the second drive roller 16. Since the first drive roller 14 is laterally fixed with respect to the sheet-supporting surface 12 (i.e., the first drive roller is allowed only rotational movement, not lateral movement), there is no need to permit the first pinch roller 22 to move laterally along the second track 36. However, if desired, the first pinch roller 22 may be mounted on the second track 36 in the same manner as the second pinch roller 24 for permitting lateral movement of the first pinch roller.

A tool carriage 38 is mounted adjacent to the second elongated track 36, and includes a tool support adapted to carry any of a plurality of tools 40 for plotting on the sheet S by performing a variety of operations. The term "plotting" is used herein to describe, without limitation, any of numerous operations whereby a tool supported on the tool carriage and the sheets or like work surface are moved relative to each other to position the tool at different points locatable by means of coordinates for working on the sheets. For example, the tool 40 may be a blade for cutting the sheets, a pen or other line drawing instrument for drawing lines or printing graphic images on the sheets, a pounce tool for perforating the sheets, an embossing tool for embossing the sheets, and/or an alignment tool for aligning the tool(s) or tool carriage with registration markings or indicia on the sheets.

As will be recognized by those skilled in the pertinent art based on the teachings herein, any of numerous different types of sheets or like work materials may be used with the plotters of the invention, such as paper, cardboard and polymeric sheets, including adhesive-backed vinyl films, metallized polyester films, heat transfer flock, plastisol, masking films for stenciling, screen-printing films, adhesive-coated film laminates, adhesive-coated rubber stencil films, flexible magnetic materials, such as the magnetic material sold by the Assignee of this invention under the trademark GERBERMAG™, and static-cling films. The term "sheet" is used herein, without limitation, to describe any of numerous different types of sheet-like materials which are thin in comparison to their length and breadth, and which may be provided in any of numerous different forms, such as in flat sheets or rolls.

As indicated by the arrows in FIG. 1, the tool 40 is movable in the z-coordinate direction into and out of contact with the sheet S, and the tool carriage 38 is driven in the y-coordinate direction to plot by, for example, printing and/or cutting on the sheet S. A control computer 42 is electrically connected to each of the electrical components of the plotter 10 to control their operation, including the tool carriage 38, plotting tool 40, and the first and second drive motors 18 and 20, respectively.

In the operation of the plotter 10, a sheet S is placed on the sheet-supporting surface 12, and a first margin (or right-hand margin in the drawing) is placed over the first drive roller 14 to permit the first drive roller to frictionally engage the underside of the sheet. Then, the drive-roller carriage 32 is moved laterally relative to the first drive roller 14 to align the second drive roller 16 with the second margin (or left-hand margin in the drawing) of the sheet S. Once the opposing margins of the sheet S are aligned with the drive rollers, the first pinch roller 22 is moved downwardly into its engaged position to press the respective margin of the sheet S against the abrasive peripheral surface of the first drive roller 14. The second pinch roller 24 is moved as required to align the second pinch roller with the corresponding margin of the sheet S and second drive roller 16, and is then moved downwardly into its engaged position to press the second margin of the sheet against the second drive roller.

Once the pinch rollers are moved into their engaged positions, the first and second drive motors 18 and 20 are actuated to rotatably drive the first and second drive rollers 14 and 16, respectively, and in turn drive the sheet S in the x-coordinate direction. The tool carriage 38 is simultaneously driven in the y-coordinate direction to create relative movement at the interface of the plotting tool 40 and sheet S in accordance with commands issued by the control computer 42 to thereby plot by, for example, printing on and/or cutting the sheet S.

One advantage of the plotter of the present invention is that the second drive roller 16 and drive motor 20 may be moved laterally relative to the first drive roller 14 to thereby define any of an infinite number of lateral spacings between the two drive rollers. Thus, the plotter of the invention can plot on sheets having any width within a predetermined range of widths defined by the overall length of the sheet-supporting surface 12.

Another advantage of the plotter of the invention is that the first and second drive motors 18 and 20, respectively, may be driven at different rotational speeds and/or in different rotational directions relative to each other to correct any skew error in the sheet S (also referred to as skew control). As indicated above, the control computer 42 is electrically connected to the first and second drive motors 18 and 20, respectively, to independently control the rotational speeds and directions of the motors, and thus the rotational speeds and directions of the drive rollers relative to each other. As shown in FIG. 1, a sensor 44 is mounted adjacent to one edge of the sheet S, and is electrically coupled to the control computer 42 for transmitting to the computer electrical signals indicative of the lateral position of the sheet S located on the sheet-supporting surface 12. In the preferred embodiment of FIG. 1, the sensor 44 is mounted adjacent to the first drive roller 14 and first pinch roller 22 to sense the lateral position of the marginal portion of the sheet passing over the sheet-supporting surface 12 adjacent to the first drive roller. However, as will be recognized by those skilled in the pertinent art based on the teachings herein, the sensor 44 may be located in any of numerous other locations, and/or additional sensors may be employed to perform the functions described herein.

The control computer 42 is responsive to the signals transmitted by the sensor 44 to command the first drive motor 18 and the second drive motor 20 to drive the first drive roller 14 and the second drive roller 16, respectively, at (i) different rotational speeds relative to each other, and/or (ii) in different rotational directions relative to each other, in order to align the sheet S with its predetermined feed path extending in the illustrated x-coordinate direction. The control computer 42 and sensor 44, and the manner in which they sense the lateral position of the sheet and control the two drive motors to correct any skew error is described in further detail in the co-pending U.S. patent application entitled "FRICTION DRIVE APPARATUS FOR STRIP MATERIAL", filed on May 29, 1998, and accorded Ser. No. 09/069,392, which is assigned to the Assignee of the present invention, and is hereby expressly incorporated by reference as part of the present disclosure.

In FIGS. 2 through 5, another apparatus embodying the present invention for plotting on sheets of different widths is indicated generally by the reference numeral 110. The plotter 110 is substantially similar to the plotter 10 described above with reference to FIG. 1, and therefore like reference numerals preceded by the numeral 1 are used to indicate like elements.

Figures 2, 2A:
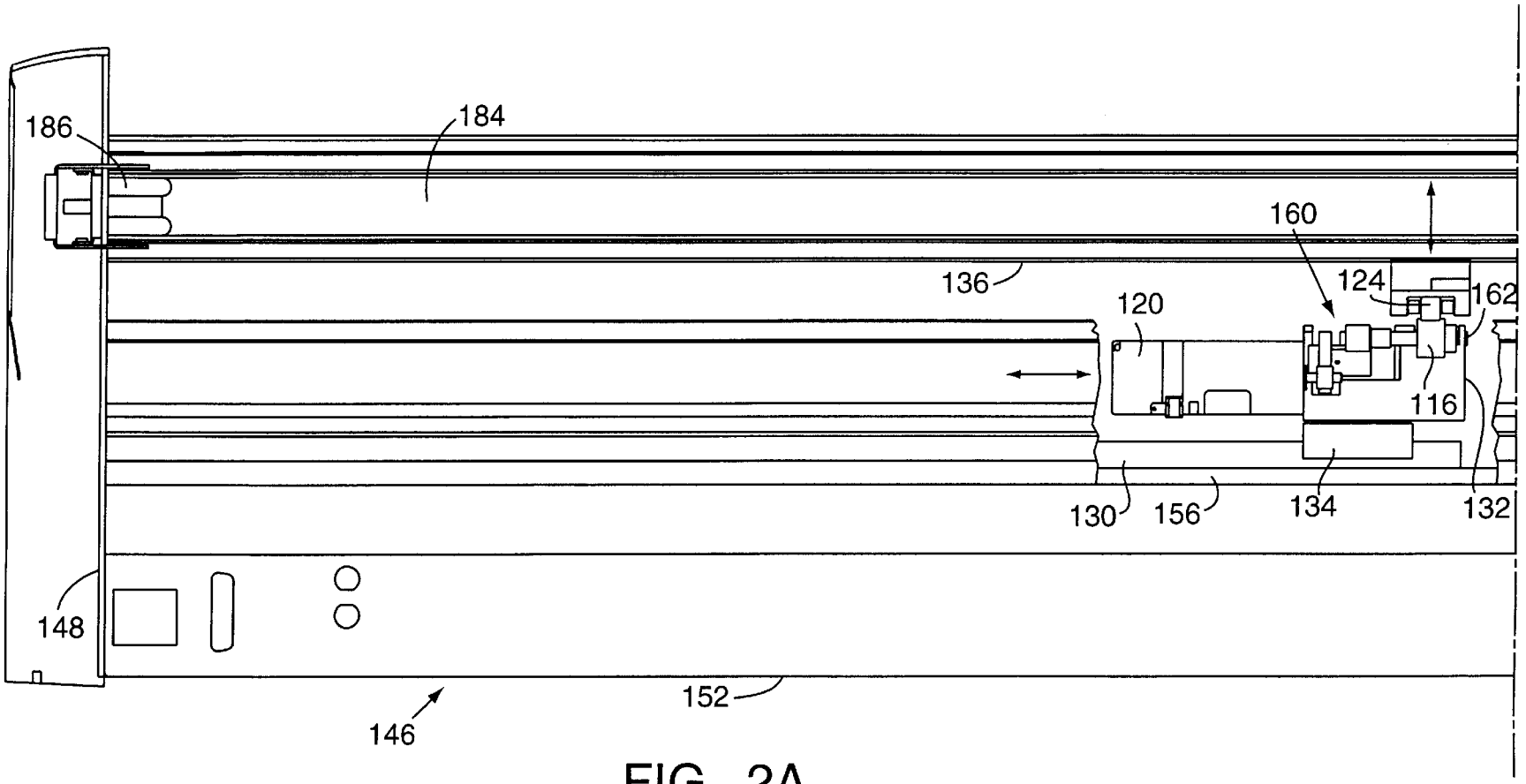
FIGS. 2A and 2B are a front elevational view of a second plotter embodying the invention employing three abrasive drive rollers and two drive motors, wherein the second drive roller and motor pair is movable laterally relative to the other two drive rollers and drive motor for plotting on sheets of different widths.
Figure 2B:
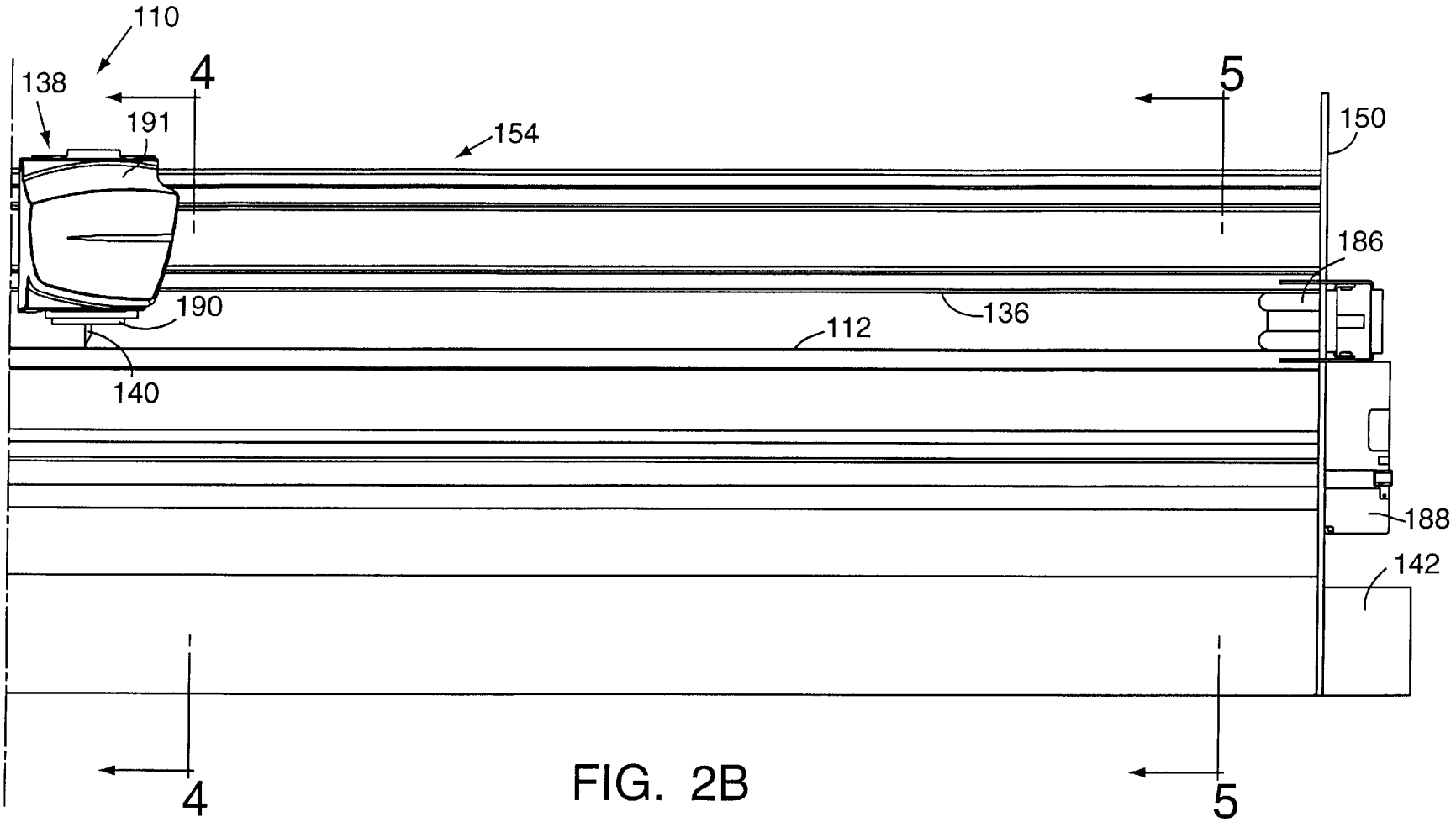
Figures 3, 3A:
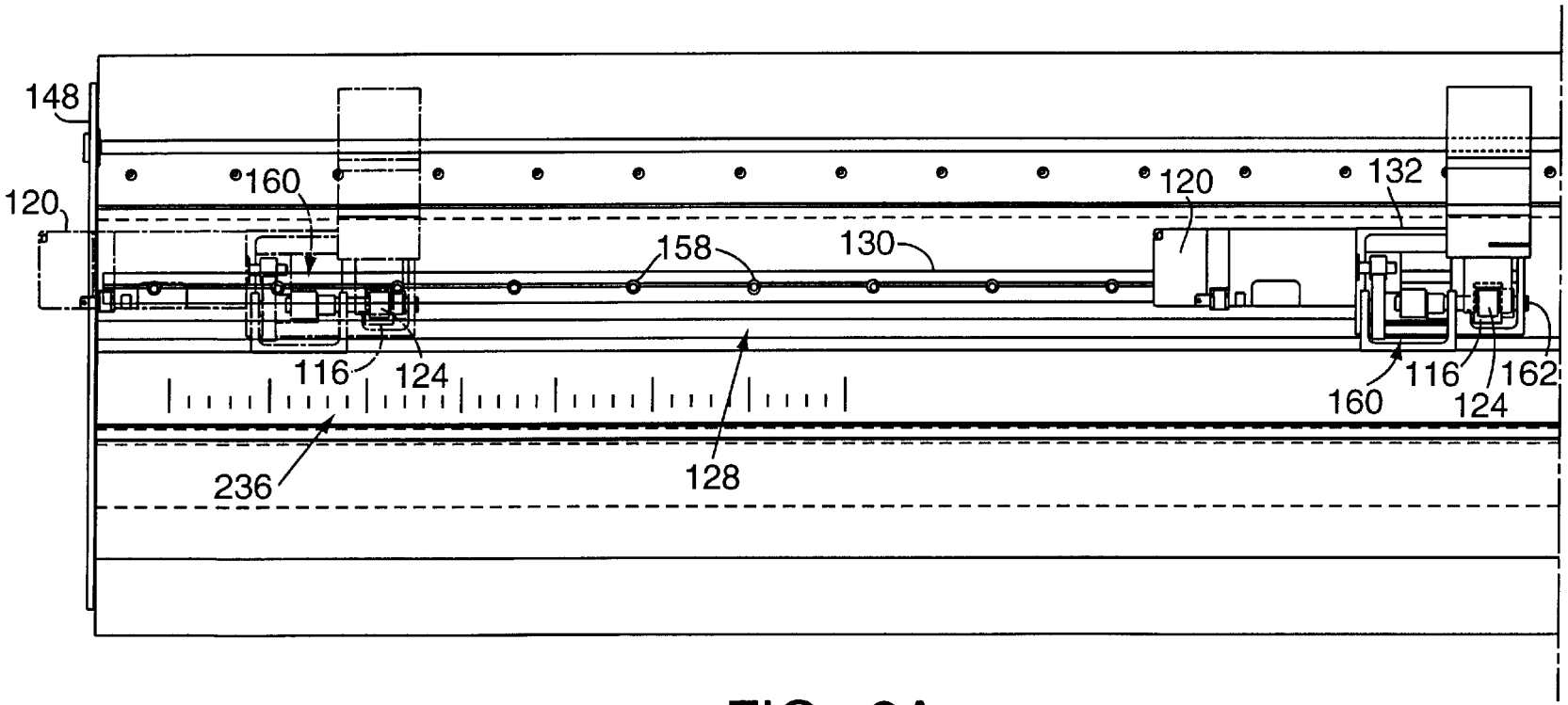
FIGS. 3A and 3B are a top plan view of the plotter of FIGS. 2A and 2B with parts removed for clarity, and showing the range of lateral movement of the second drive roller and motor pair by illustrating in broken lines the second drive roller and motor pair at its outermost position, and illustrating in solid lines the second drive roller and motor pair at its innermost position adjacent to the sheet-supporting surface.

As shown in FIGS. 2 and 3, the plotter 110 comprises a frame 146 including a left end plate 148 (FIG. 2A), a right end plate 150 (FIG. 2B), and an underside or base 152 extending between the two end plates (FIG. 2A). The base 152 may be mounted to a table top, or alternatively, may be mounted on a stand which may include suitable wheels for conveniently moving the plotter (not shown).

Figure 5:
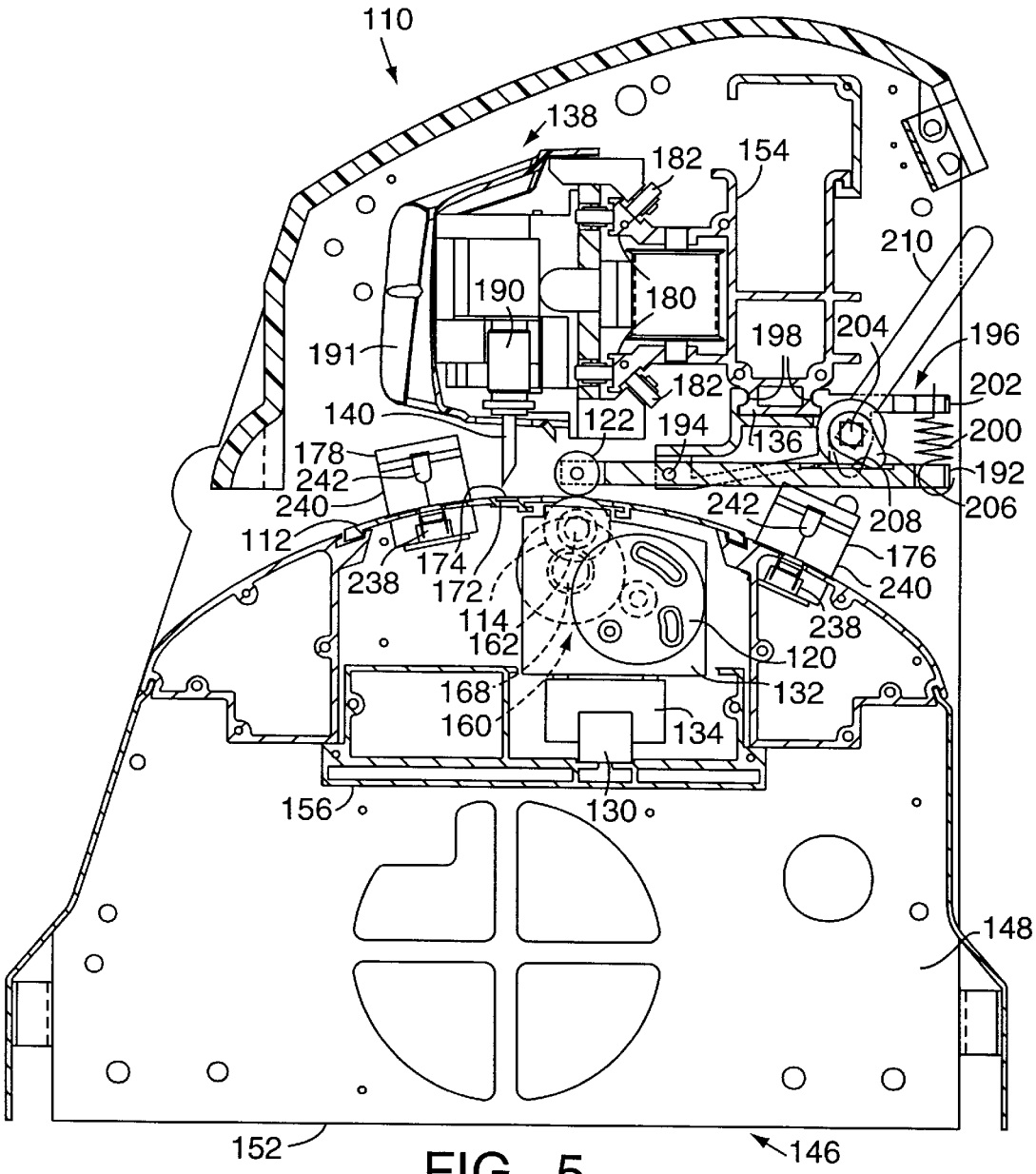
FIG. 5 is a partial cross-sectional view of the plotter taken along line 5—5 of FIG. 2B showing in further detail the first pinch roller assembly and first abrasive drive roller, and the sensors mounted adjacent to the first drive roller for sensing and eliminating any skewing of the sheet.

As shown best in FIGS. 2A and 2B, the tool carriage 138 is mounted on a y-beam 154 extending between the left and right end plates 148 and 150, respectively, for movement in the illustrated y-coordinate direction. The elongated sheet-supporting surface 112 is spaced below the tool carriage 138, and is fixedly secured between the left and right end plates 148 and 150, respectively. An elongated support beam 156 is spaced below the sheet-supporting surface 112, and extends between the left and right end plates 148 and 150, respectively, for supporting the first and second abrasive drive rollers 114 and 116, respectively, and the second drive motor 120. The first elongated track or way 130 is fixedly mounted on the support beam 156 by fasteners shown typically at 158 in FIG. 3A. The first elongated track or way 130 extends below and adjacent to a substantial portion of the sheet-supporting surface 112 and elongated aperture 128 formed adjacent thereto, to permit movement of the second abrasive drive roller 116 to any location along the length of the first track. As shown in FIGS. 2A and 5, the bearing assembly 134 is mounted to the first elongated track 130, and the drive-roller carriage 132 is mounted to the bearing assembly for slidable movement with the bearing assembly along the first track. The second drive motor 120 is fixedly mounted to one side of the drive-roller carriage 132, and the output shaft of the second drive motor is drivingly connected through a suitable gear train 160 to a second drive shaft 162. The second abrasive drive roller 116 is rotatably mounted on the second drive shaft 162, and the shaft is in turn rotatably mounted on the drive carriage 132 and drivingly connected to the output end of the gear train 160.

Figure 3B:
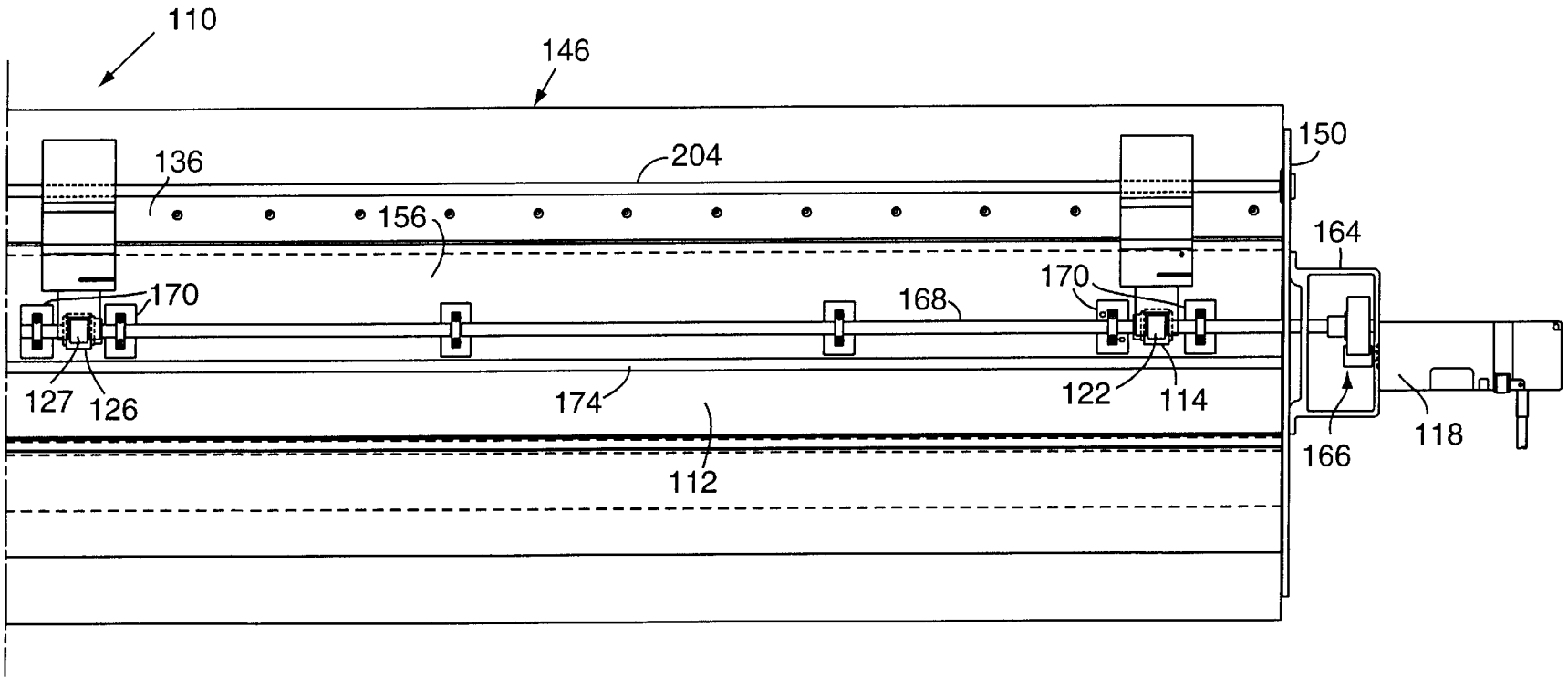

As shown in FIG. 3B, the first drive motor 118 is fixedly secured to a motor mount 164, and the motor mount is attached to the outer surface of the right end plate 150. The output shaft of the first drive motor 118 is connected through one or more gears 166 to a first drive shaft 168. AS shown in FIG. 3B, the first drive shaft 168 extends in the illustrated y-coordinate direction beneath a substantial portion of the sheet-supporting surface 112 and terminates adjacent to the end of the first elongated track or way 130. The first abrasive drive roller 114 is keyed or otherwise fixedly secured to the drive shaft 168 at the end of the sheet-supporting surface 112 adjacent to the right end plate 150, and the first drive roller and shaft are rotatably mounted on the support beam 156 by a pair of bearing mounts 170 located on opposite sides of the first drive roller. A third abrasive drive roller 126 is keyed or otherwise fixedly secured to the free end of the first drive shaft 168, and the third drive roller and shaft are rotatably mounted on the support beam 156 by another pair of bearing mounts 170 located on opposite sides of the third drive roller. As shown in FIG. 3B, the third drive roller 126 is located adjacent to approximately the middle of the sheet supporting surface 112, the first drive roller 114 is located adjacent to the right end of the sheet-supporting surface, and the elongated aperture 128 and elongated track 130 extend adjacent to approximately the left end to the middle of the sheet-supporting surface. Thus, as indicated in FIG. 3A, the second drive roller 116 can be located at any position along the elongated track 130 to engage the left-hand margin of a sheet S. The right-hand margin of the sheet may be engaged by either the first drive roller 114 or the third drive roller 126. For relatively wide sheets, the right-hand margin is engaged by the first drive roller 114, the left-hand margin is engaged by the second drive roller 116, and a mid-portion of the sheet is engaged by the third drive roller 126.

In the currently-preferred embodiment of the invention, the third drive roller 126 is located adjacent to approximately the middle of the sheet-supporting surface 112 in order to minimize the overall length of the first elongated track 130 while still maintaining the capability to handle a sufficiently broad range of sheet widths. However, as will be recognized by those skilled in the pertinent art based on the teachings herein, the third drive roller 126 may be located at any desired position between the first and second drive rollers. Alternatively, the third drive roller 126 may be eliminated as in the embodiment of FIG. 1, or if desired, additional drive rollers may be mounted on the first drive shaft 168.

Figure 4:
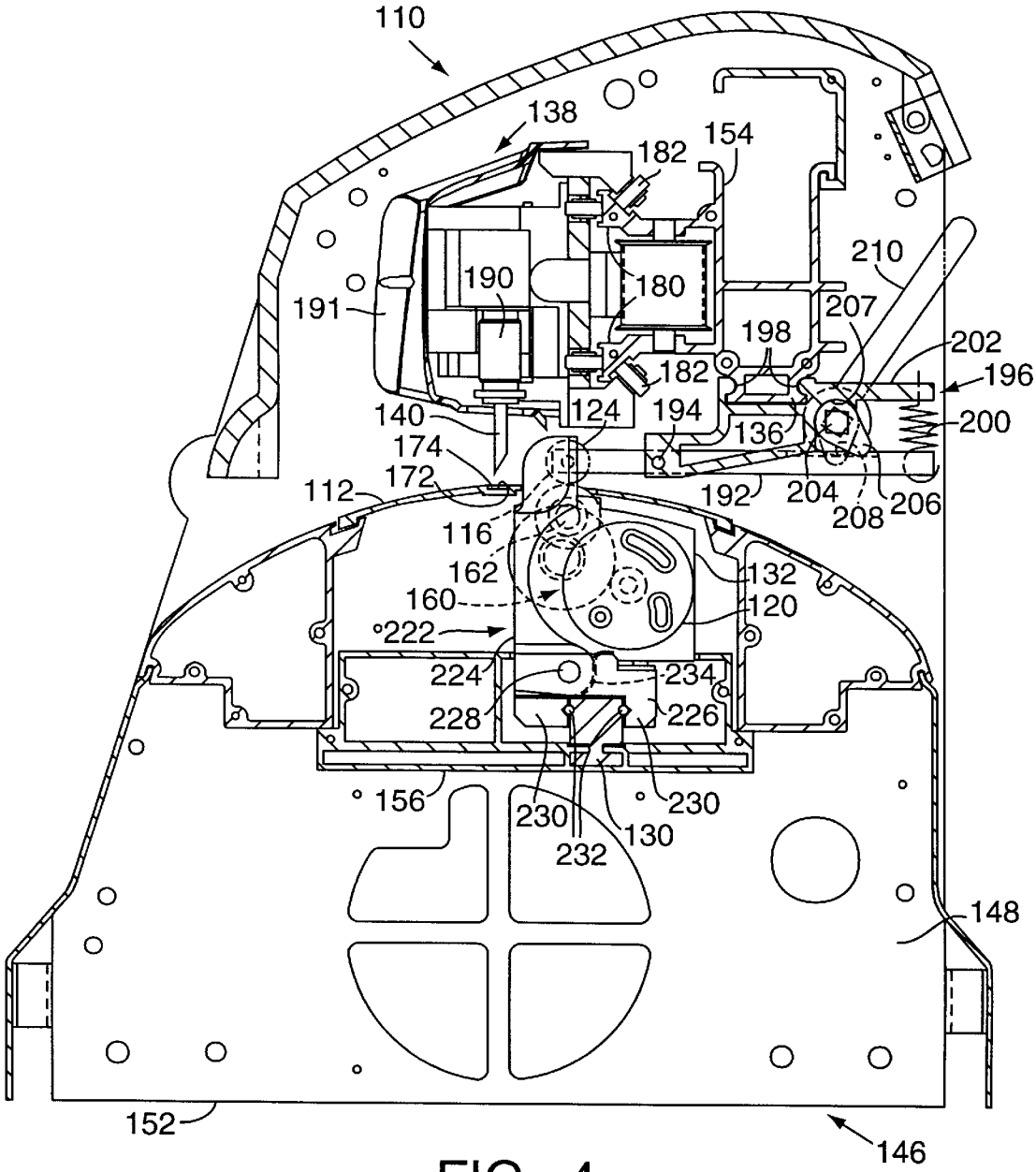
FIG. 4 is a partial cross-sectional view of the plotter taken along line 4—4 of FIG. 2B showing in further detail the second pinch roller assembly and second abrasive drive roller, and the drive-roller carriage for laterally moving the second drive roller.

As shown in FIGS. 4 and 5, the sheet-supporting surface 112 defines an elongated recess 172 extending in the elongated direction from one end of the sheet-supporting surface to the other. An elongated strip of polymeric material forming a relatively hard and low-friction support surface 174 is received within the recess 172, and the exposed face of the strip is approximately coterminous with the outermost regions of the sheet-supporting surface 112. In the currently-preferred embodiment of the invention, the support surface 174 is formed by a high-density, polyethylene strip having a pressure-sensitive adhesive backing, such as the type sold by 3M, for removably attaching the strip to the base of the recess 172. The high-density polyethylene provides a relatively hard, resilient support surface, so that if the tool 140 carried on the tool carriage 138 (e.g., a knife blade) is mistakenly driven through the sheet S, the tool may penetrate the strip 174, thus preventing damage to the tool and otherwise preventing damage to the permanent surfaces of the plotter. The elongated strip 174 may be periodically replaced, if necessary, to ensure the provision of a smooth and undamaged support surface.

As shown in FIG. 5, the means for sensing the lateral position of the sheet S includes a first sensor 176 and a second sensor 178 mounted on the sheet-supporting surface 112 adjacent to, and on opposite sides of the first abrasive drive roller 114 relative to each other. As described in the above-mentioned copending patent application, depending upon the direction of movement of the sheet S in the illustrated x-coordinate direction (i.e., to the left or right in FIG. 5), the sensor disposed behind the abrasive drive rollers with respect to the direction of motion, detects and ensures that the sheet S does not move laterally in the illustrated y-coordinate direction. In the currently-preferred embodiment, each sensor 176 and 178 is an optical sensor which generates a digital output signal indicative of the position of the edge of the sheet S on the respective sensor array. As shown in FIG. 5, each sensor 176, 178 includes a linear array 238 mounted beneath the sheet-supporting surface 112 with the array received within an aperture formed through the sheet-supporting surface. A sensor bracket 240 is mounted on the opposite side of the sheet-supporting surface, and a light source 242, such as a photodiode, is mounted on the bracket over the respective sensor array.

In operation, the voltage signal of each sensor 176, 178 is indicative of the position of the edge of the sheet S on the linear array. Thus, if the output signal of the selected sensor (depending upon the direction of movement of the sheet S) indicates that the edge of the sheet S in located over the middle of the array (or other desired position), the control computer 142 simultaneously drives the two motors, and thus the abrasive rollers 114, 116 and 126 at the same peripheral speed. If, however, the selected sensor generates a signal indicating that the edge of the sheet is positioned at a point on the array other than the desired position, the control computer 142 applies a differential signal on the signals transmitted to the first and second drive motors 118 and 120, respectively. The differential signal results in differential peripheral speeds of the second abrasive drive roller 116 in comparison to the first and third abrasive drive rollers 114 and 126, respectively, to in turn bring the edge of the sheet to the desired position on the sensor array and thereby correct any skew error. If desired, the control computer 142 may rotatably drive the first abrasive drive roller 114 and second abrasive drive roller 116 in different directions relative to each other to likewise bring the edge of the sheet S to the desired position on the sensor array. Similarly, it may be desirable to drive the first and second drive rollers at different rotational speeds and in different rotational directions in order to bring the edge of the sheet to the desired position on the sensor array. As will be recognized by those skilled in the pertinent art based on the teachings herein, any of numerous different types of sensors may be employed to perform the function of the sensors described herein. For example, it may be desirable to employ an optical sensor which generates an analog signal indicative of the amount of light impinging on the sensor array, and thus indicative of the degree to which the respective marginal portion of the sheet is overlying the array (i.e., the percentage of the array covered by the sheet).

As shown in FIGS. 4 and 5, the y-beam 154 comprises two pairs of ways 180 extending between the two end plates 148 and 150 in the illustrated y-coordinate direction, and the tool carriage 138 includes opposing sets of roller bearings 182 received within the ways for moving the tool carriage along the y-beam. As shown in FIGS. 2A and 2B, a drive belt 184 is mounted at each end plate 148 and 150 on a respective pulley 186, and the belt is connected to the tool carriage 138 for movement of the carriage with the belt. A y-drive motor 188 is drivingly connected through the pulleys 186 to the belt 184 to drive the belt, and in turn drive the tool carriage 138 in the illustrated y-coordinate direction. The tool carriage 138 includes a tool support 190 which is spaced above and adjacent to the elongated strip 174 (FIGS. 4 and 5) for supporting a tool 140 and moving the tool in the illustrated z-coordinate direction into and out of engagement with the sheet S. The tool support 190 may take the form of any of numerous different tool supports currently known, or which later become commercially available or otherwise known to those skilled in the pertinent for performing the function of the tool support described herein. Similarly, the tool 140 may take the form of a blade for cutting the sheet S, or as described above, the tool may be any of numerous different tools known to those skilled in the pertinent art for plotting on the sheets. As shown in FIGS. 4 and 5, the tool carriage 138 may include a cover 191 for enclosing the components of the carriage.

As shown in FIGS. 3A and 3B, the plotter 110 comprises a first pinch roller assembly 122 mounted over the first drive roller 114, a second pinch roller assembly 124 mounted over the second drive roller 116, and a third pinch roller assembly 127 mounted over the third drive roller 126. As shown in FIGS. 2A and 2B, the y-beam 154 defines the second elongated track 136 extending above the sheet-supporting surface 112 from approximately one end of the sheet-supporting surface to the other. As shown typically in FIGS. 4–6, each of the pinch rollers 122, 124 and 127 is rotatably mounted on a first end of a respective pinch roller arm 192, and the pinch roller arm 192 is pivotally mounted by a pin 194 to a respective slide carriage 196. Each slide carriage 196 defines a pair of opposing lobes or like protuberances 198 which are slidably received within corresponding grooves formed on the second elongated track 136, in order to retain the slide carriage on the track and, if desired, permit the carriage to slide along the track in the y-coordinate direction. In the illustrated embodiment of the invention, the slide carriages 196 for the first pinch roller 122 and third pinch roller 127 are secured by fasteners (not shown) to prevent lateral movement of the first and third pinch rollers along the second elongated track. However, if desired, the first and third pinch rollers may be permitted to move laterally relative to each other or the second pinch roller, particularly if the first and/or third drive rollers are permitted to move laterally relative to the other rollers. A coil spring or other biasing device 200 is connected between the second end of each pinch roller arm 192 and a laterally-extending arm 202 of the respective slide carriage 196 to bias the second end of the pinch roller arm upwardly, and in turn bias the respective pinch roller 122, 124 or 127 downwardly against the respective drive roller.

A square shaft 204 is mounted between the left and right end plates 148 and 150, respectively, and extends in the y-coordinate direction adjacent to each slide carriage 196. As shown typically in FIG. 4, for each of the first pinch roller 122 and second pinch roller 124, a respective cam 206 is mounted on the square shaft 204, and the external surface of the cam is received within a curved bearing surface 207 of the respective slide carriage 196. Each pinch roller arm 192 defines a recess 208 located adjacent to the respective cam 206 for slidably receiving the lobe of the cam. A handle 210 is keyed or otherwise fixedly secured to one end of the square shaft 204 to manually rotate the shaft, and in turn move the first and second pinch rollers 122 and 124, respectively, between their engaged and disengaged positions. More specifically, movement of the handle 210 and square shaft 204 in the clockwise direction of FIGS. 4 and 5 causes the cams 206 to pivot the second end of each pinch roller arm 192 downwardly, and in turn pivot the first end of the pinch roller arm and respective pinch roller 122 or 124 upwardly into its dis-engaged position. Then, movement of the handle 210 and square shaft 204 in the counter-clockwise direction of FIGS. 4 and 5, permits each spring or like biasing device 200 to pivot the second end of each pinch roller arm 192 upwardly, and in turn pivot the respective pinch roller 122 or 124 downwardly against the sheet S and respective drive roller 114 or 116. The force with which the pinch rollers are pressed against the drive rollers may be controlled by selecting the size of the spring and/or the length of the pinch roller arms.

Figure 6:
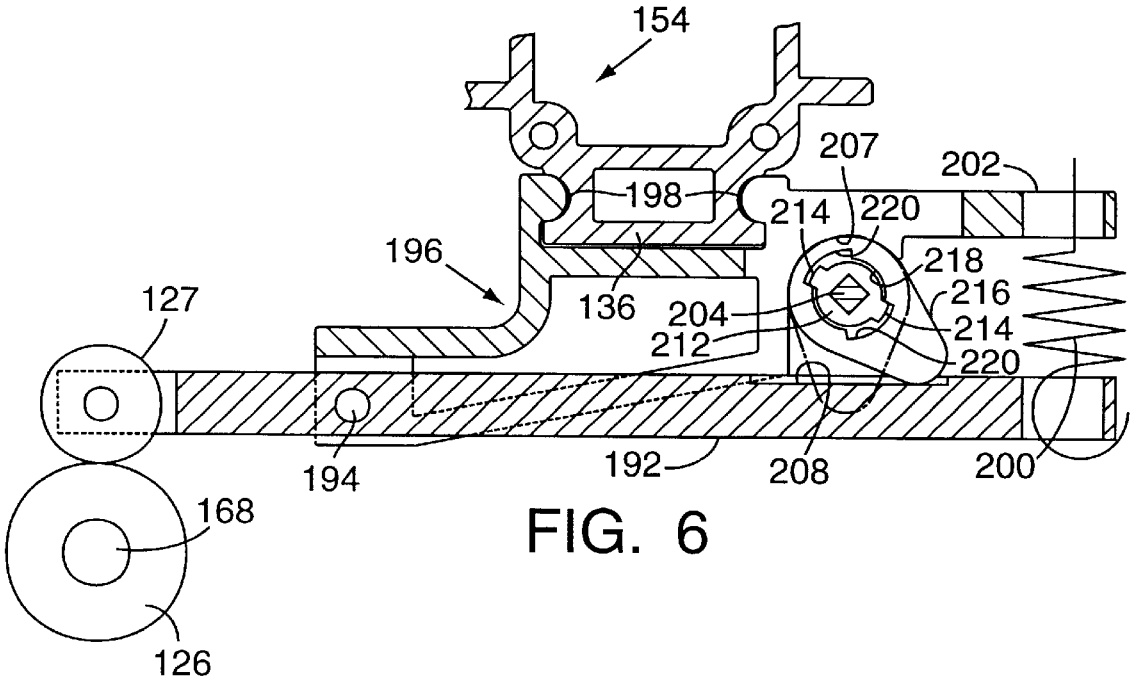
FIG. 6 is a partial cross-sectional, side elevational view of the slide carriage of the third pinch roller assembly of FIG. 3B.

When employing skew control as described above, it may be desirable to disengage the third pinch roller 127 and engage only the marginal portions of the sheet with the first and second pairs of pinch and drive rollers. When the third pinch roller 127 is engaged with the sheet S against the third drive roller 126, it may prevent lateral movement of the sheet and therefore prevent correction of any skew error by either driving the first and second motors at differential speeds or in different rotational directions. Accordingly, the plotter 110 preferably includes means for dis-engaging the third pinch roller while simultaneously engaging the first and second pinch rollers during periods of skew control. Accordingly, as shown in FIG. 6, the slide carriage 196 of the third pinch roller 127 includes a cam actuator 212 defining a square aperture for slidably receiving and mounting the cam actuator to the square shaft 204. The cam actuator 212 includes a pair of diametrically opposed lobes 214. A cam 216 defining a central aperture 218 is slidably mounted over the cam actuator 212, and a pair of diametrically opposed, laterally-extending grooves 220 receive the lobes 214 of the cam actuator 212. The lobe of the cam 216 is received within the recess 208 of the respective mounting arm 192, and the opposite side of the cam is slidably received within the curved bearing surface 207 of the respective slide carriage 196.

Accordingly, initial rotation of the handle 210 and square shaft 204 in the counter-clockwise direction of FIGS. 4, 5 and 6 causes the lobes of the cams 206 of the first and second pinch rollers 122 and 124 to move upwardly, and thereby allow the springs 200 to move the first and second pinch rollers into their engaged positions. However, during this initial rotation of the handle 210 and square shaft 204, the lobes 214 of the cam actuator 212 (FIG. 6) rotate through the laterally-extending grooves 220 of the cam 216, and therefore do not cause rotation of the cam 216 and corresponding movement of the third pinch roller 127. Accordingly, in this position, the first and second pinch rollers 122 and 124 are engaged and the third pinch roller 127 is dis-engaged to thereby permit the first and second drive motors to be operated at differential speeds to effect skew control. Then, once any skew error is corrected, the handle 210 and square shaft 204 are further rotated in the counter-clockwise direction to cause the lobes 214 of the cam actuator 212 to engage the corners of the grooves 220 and rotate the cam 216 in the same direction. This pivots the lobe of the cam 216 upwardly, and in turn allows the respective spring 200 to pivot the third pinch roller 127 downwardly into its engaged position.

The plotter 110 further comprises means for locking the lateral position of the second drive roller 116 relative to the first and third drive rollers 114 and 126, respectively. AS shown in FIG. 4, a locking unit 222 is fixedly secured to the drive-roller carriage 132 and includes a lever arm 224 pivotally mounted to a base 226 by a pivot pin 228. The base 226 includes a pair of locking arms 230 which extend downwardly on opposite sides of the elongated track 130 relative to each other. A pair of elongated pins 232 are each fixedly secured to a respective locking arm 230, and disposed between the respective locking arm and the adjacent surface of the track 130. As shown in phantom in FIG. 4, a curved spring 234 is seated adjacent to the pivot pin 228 between the base 226 and lever arm 224. The spring 234 normally urges the locking arms 230 downwardly, and in turn biases or urges the pins 232 into engagement with the adjacent surfaces of the track 130 to lock the drive-roller carriage 132 in place on the track.

In order to move the drive-roller carriage 132 along the track 130, the lever arm 224 is pivoted inwardly toward the drive motor 120. This in turn pivots the locking arms 230 away from each other, and thereby releases the pins 232 from the track to permit slidable movement of the drive-roller carriage 132 along the track. Once the drive-roller carriage 132 and second drive roller 116 are located in the desired position, the lever arm 224 is released to permit the locking arms 230 and pins 232 to pivot inwardly toward each other and lock the lateral position of the drive-roller carriage and second drive roller in place. As shown typically in FIG. 3A, the sheet-supporting surface 112 preferably includes indicia 236 defining a scale located adjacent to the elongated aperture 128 wherein the indicia of the scale are indicative of the distance between the respective point on the sheet-supporting surface and the first and/or third drive rollers 114 and 126, respectively. If the operator knows the width of the sheet S, then he or she may move the second drive roller 116 adjacent to the point on the scale corresponding to the width of the sheet to thereby set the distance between the drive rollers to correspond to the width of the sheet.

As mentioned above, it may be necessary when plotting on relatively narrow sheets to not employ the first pinch and drive roller pair 122, 114, and to instead engage one margin of the sheet with the second pinch and drive roller pair 124, 116 and engage the opposing margin of the sheet with the third pinch and drive roller pair 127, 126. In order to perform skew control on relatively narrow sheets of this type, it is necessary to mount at least one additional sensor 176 or 178 adjacent to either the first or third pinch and drive roller pair in order to sense the lateral position of a relatively narrow sheet. In the currently-preferred embodiment of the invention, at least one sensor array 238 is mounted adjacent to the third drive roller 126 in the same manner as either sensor array 238 of FIG. 5. Preferably, the sensor brackets 240 are plug-in type brackets, wherein each bracket may be manually plugged into, and unplugged from its respective array. Accordingly, when plotting with only the second and third drive and pinch roller pairs, one of the sensor brackets 240 of FIG. 5 may be unplugged from its respective sensor array 238, and plugged into the sensor array 238 mounted adjacent to the third drive roller 126. If two sensor arrays 238 are mounted adjacent to the third drive roller 126 in the same manner as the sensor arrays of FIG. 5, then both sensor brackets 240 may be unplugged from the sensor arrays mounted adjacent to the first drive roller 114, and plugged into the sensor arrays mounted adjacent to the third drive roller 126. Alternatively, it may be desirable to mount the light sources 242 of the sensors on the slide carriages 196 of the first and third pinch rollers 122 and 127, respectively, so that each light source is properly positioned over its respective sensor array. One advantage of this configuration is that there is no need to either employ plug-in type sensor brackets or move the brackets or light sources depending upon the width of the sheet to be plotted on. In the operation of the plotter 110, a sheet S is placed on the sheet-supporting surface 112, and a first margin (or right-hand margin in the drawings) is placed over the first drive roller 114 to permit the first drive roller to frictionally engage the underside of the sheet. The drive-roller carriage 132 is then moved laterally along the track 130 by manipulating the locking unit 222 in the manner described above to align the second drive roller 116 with the second margin (or left-hand margin in the drawings) of the sheet S. Alternatively, if the width of the sheet S is known, the second drive roller 116 may be aligned with the corresponding point along the scale defined by the indicia 236 (FIG. 3A) to set the distance between the first and second drive rollers to correspond to the width of the sheet. If the sheet is relatively narrow, then the first or right-hand margin of the sheet may be placed over the third drive roller 126 and the first drive roller 114 may not be employed. The slide carriage 196 of the second pinch roller 124 is then slidably moved along the track 136 to align the second pinch roller with the second drive roller.

Once the opposing margins of the sheet S are aligned with the first and second pairs of pinch and drive rollers, the handle 210 of FIG. 4 is moved to rotate the cams 206 of the first and second pinch rollers 122 and 124, respectively, upwardly in FIG. 4. This in turn allows the corresponding springs 200 to pivotally urge the first and second pinch rollers 122 and 124, respectively, downwardly against the opposing margins of the sheet S, and in turn causes the first and second drive rollers to frictionally engage the sheet. Alternatively, for relatively narrow sheets, the opposing margins of the sheets may be frictionally engaged between the second pinch and drive roller pair on one side, and the third pinch and drive roller pair on the opposite side of the sheet. The control computer 142 actuates the first and second drive motors 118 and 120, respectively, to drive the sheet forwardly in the x-coordinate direction and in turn "pull down" a predetermined length of sheet. During this "pull down" period, and for relatively large-width sheets engaged by all drive rollers, the third pinch roller 127 remains dis-engaged from the sheet, and the sensors 176 and 178 are actuated to correct any skew error in the sheet to thereby align the sheet with its feed path in the x-coordinate direction prior to plotting on the sheet. In the currently-preferred embodiment of the invention, the control computer "pulls downs" approximately twelve (12) inches of the sheet S. However, as will be recognized by those skilled in the pertinent art based on the teachings herein, any other desired predetermined length of sheet may be employed. The predetermined length of sheet is first driven forwardly over the sheet-supporting surface 112, and is then driven rearwardly (or in the opposite direction) over the sheet-supporting surface. While driving the predetermined length of sheet, the sensors 176 and 178 sense the lateral position of the sheet. If the sheet is not properly aligned with its feed path extending in the x-coordinate direction, the control computer 142 is responsive to the signals transmitted by the sensors to command the first drive motor 118 and the second drive motor 120 to rotate the first drive roller 114 and the second drive roller 116, respectively, at different speeds relative to each other, and/or to rotate the first drive roller and the second drive roller, respectively, in different directions relative to each other, in order to align the sheet S with its feed path as described above. Once the sheet is rearwardly driven and returned to its start position, the sheet will be aligned with its feed path in the x-coordinate direction.

Then, for relatively larger-width sheets, the handle 210 is further rotated in the counter-clockwise direction of FIG. 4 to rotate the cam 216 of the third pinch roller 127. This in turn allows the respective spring 200 to pivotally urge the third pinch roller 127 downwardly against the adjacent portion of the sheet S to frictionally engage the underside of the sheet with the third drive roller 126. At this point, the control computer controls actuation of the first and second drive motors 118 and 120, respectively, to drive the sheet in the x-coordinate direction, controls actuation of the y-drive motor 188 to drive the tool carriage 138 in the y-coordinate direction, and controls actuation of the tool support 190 to move the plotting tool 140 in the z-coordinate direction to plot by, for example, cutting and/or printing on the sheet.

Once the plot is completed for the predetermined length of sheet S, the control computer disengages the tool 140 from the sheet, and "pulls down" another predetermined length of sheet for continuing the plot on another section of the sheet. In the currently-preferred embodiment of the invention, the skew control (or skew elimination) steps are performed by the control computer during each pull-down period. Then, once each predetermined length of sheet is pulled down and properly aligned with its feed path, skew control is terminated and the control computer actuates the tool carriage to plot on the respective predetermined length of sheet. Thus, during each pull down and skew control period, the third pinch roller 127 is dis-engaged from the sheet, and the predetermined length of sheet is driven forwardly and then rearwardly in the x-coordinate direction. The sensors 176 and 178 are simultaneously activated, and the drive motors 118 and 120 are driven, if necessary, at differential speeds and/or different rotational directions, to laterally align the sheet. Once the predetermined length of sheet is driven rearwardly to its original position at the start of the pull down, the third pinch roller 127 is re-engaged with the sheet, and the control computer 142 performs the plot on the predetermined length of sheet. This procedure is repeated for each predetermined length of sheet until the plot is completed on the sheet.

Figure 7:
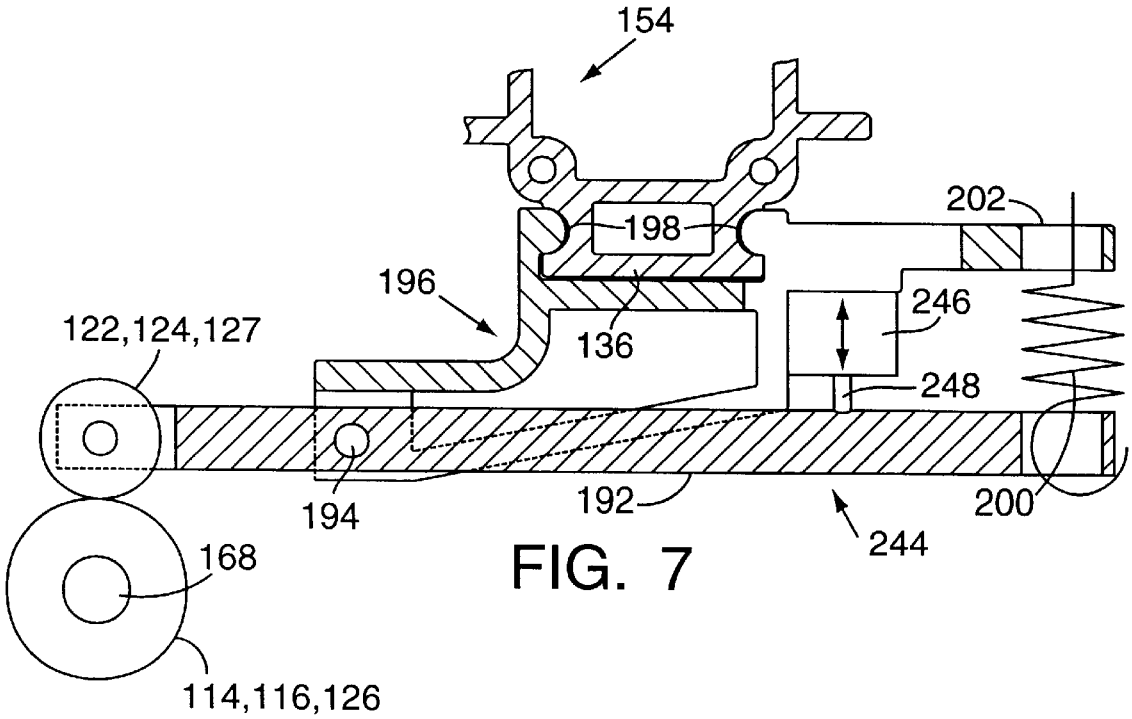
FIG. 7 is a side elevational view of another embodiment of a pinch roller assembly of the invention employing a solenoid-actuated plunger for moving the respective pinch roller between its engaged and dis-engaged positions.

In FIG. 7, a modified pinch roller assembly for use in the plotters of the invention is indicated generally the reference numeral 244. The pinch roller assembly 244 is substantially similar to the assemblies for each of the pinch rollers 122, 124 and 127 described above, and therefore the same reference numerals are used to identify the same elements. The primary difference of the pinch roller assembly 244 in comparison to those described above, is that it comprises means for electrically actuating the respective pinch roller between its dis-engaged position spaced away from the sheet, and its engaged position pressing the sheet against the abrasive surface of the respective drive roller. Also in the currently-preferred embodiment, the means for electrically actuating the pinch roller is in the form of a solenoid-actuated plunger 246 mounted on the slide carriage 196, wherein the tip 248 of the plunger engages the upper side of the pinch roller arm 192. The plunger 246 is electrically coupled to the control computer 142 to control its actuation. Also in the currently-preferred embodiment, the solenoid-actuated plunger 246 is a latching solenoid, which is pulsed "on" to move the plunger tip 248 in either direction. However, as will be recognized by those skilled in the pertinent art based on the teachings herein, the means for electrically actuating each pinch roller between its engaged and dis-engaged positions may take the form of any of numerous structures currently known, or which later become commercially available or otherwise known to those skilled in the pertinent for performing the function described herein. For example, the plunger, pinch roller arm, or pinch roller may be driven between the engaged and dis-engaged positions by any of numerous different types of solenoids, voice coils, or other electromagnetic devices for performing this function.

In order to move the pinch rollers 122, 124 and/or 127 upwardly into their dis-engaged positions, the control computer 142 actuates each solenoid to drive the respective plunger tip 248 downwardly against the pinch roller arm 192 and thereby pivot the respective pinch roller upwardly into its dis-engaged position. In order to move the pinch rollers 122, 124 and/or 127 downwardly into their engaged positions, on the other hand, the solenoid is actuated to move the plunger tip 248 upwardly, and in turn permit the spring 200 to pivot the respective pinch roller downwardly into its engaged position against the sheet and respective drive roller 114, 116 or 126. Thus, the pinch roller assembly 244 is particularly suitable for use as the third pinch roller 127 in order to permit the control computer 142 to automatically disengage the third pinch roller when performing skew control, and to automatically engage the third pinch roller when not performing skew control. However, if desired, the pinch roller assembly 244 may be employed for each of the pinch rollers to permit the control computer to automatically engage and dis-engage each pinch roller as desired.

As will be recognized by those skilled in the pertinent art based on the teachings herein, numerous changes and modifications may be made to the above-described and other embodiments of the present invention without departing from its scope as defined in the appended claims. For example, the plotter may include drive rollers in addition to those described above, and if desired, the additional drive roller(s) may be movable laterally relative to the other drive rollers in the same manner as the second drive roller described above. The plotter likewise may include additional pinch roller assemblies, or alternatively, the plotter may include fewer pinch rollers than drive rollers, and the pinch rollers may be movable laterally over the drive rollers to engage selected drive rollers. Similarly, it may be desirable to provide any of numerous known means for selectively engaging and dis-engaging, and if desired, selectively controlling the pressure applied by one or more of the pinch rollers against the sheet and corresponding drive roller.

The laterally-movable drive roller(s) and the corresponding drive motor likewise may take any of numerous different configurations known to those skilled in the pertinent art based on the teachings herein. For example, the second drive motor may be fixedly mounted and define an elongated drive shaft, and the second drive roller may be movable laterally along the drive shaft. In addition, the carriage or other support for the laterally-movable drive roller may be driven by, for example, a lead screw, drive belt or other known drive mechanism, and the drive mechanism may be actuated by the control computer to automatically drive the laterally movable drive roller to the desired position.

Accordingly, this detailed description of preferred embodiments is to be taken in an illustrative, as opposed to a limiting sense.

What is claimed is:

1. An apparatus for plotting on sheets of different widths, comprising:

a sheet-supporting surface for supporting a sheet;

a tool support spaced apart from and movable in a first coordinate direction relative to the sheet-supporting surface for plotting on the sheet;

a first drive roller rotatably mounted on a first drive shaft and defining an abrasive surface for engaging a first marginal portion of the sheet and driving the sheet in a second coordinate direction;

a second drive roller rotatably mounted on a second drive shaft and spaced laterally relative to the first drive roller, wherein the second drive roller defines an abrasive surface for engaging a second marginal portion of the sheet and further driving the sheet in the second coordinate direction, and at least one of the first and second drive rollers is movable laterally relative to the other for engaging first and second marginal portions of sheets of different widths;

a first drive motor coupled to the first drive roller for rotatably driving the first drive roller; and a second drive motor coupled to the second drive roller for rotatably driving the second drive roller;

wherein the second drive roller and second drive motor are both movable laterally relative to the first drive roller.

2. An apparatus as defined in claim 1, further comprising:

a first pinch roller mounted adjacent to the first drive roller and movable between an engaged position pressed into engagement with a sheet against the first drive roller, and a dis-engaged position spaced away from the first drive roller; and a second pinch roller mounted adjacent to the second drive roller and movable between an engaged position pressed into engagement with a sheet against the second drive roller, and a dis-engaged position spaced away from the second drive roller, wherein at least one of the first and second pinch rollers is movable laterally relative to the other for engaging sheets of different widths.

3. An apparatus as defined in claim 2, further comprising:

a third drive roller spaced laterally between the first and second drive rollers, and coupled to the first drive motor for rotation by the first drive motor with the first drive roller; and a third pinch roller spaced laterally between the first and second pinch rollers, and movable between an engaged position pressed into engagement with a sheet against the third drive roller, and a dis-engaged position spaced away from the third drive roller.

4. An apparatus as defined in claim 1, wherein an elongated aperture is formed adjacent to the sheet-supporting surface, the abrasive surface of the second drive roller extends through the aperture for contacting a sheet supported on the sheet-supporting surface, and the second drive roller is movable laterally through the aperture relative to the first drive roller for engaging the marginal portions of sheets of different widths.

5. An apparatus as defined in claim 1, further comprising:

an elongated track spaced apart from the sheet-supporting surface and extending in the first coordinate direction; and a drive-roller carriage mounted on the track and rotatably supporting the second drive roller, and movable with the second drive roller along the elongated track for adjusting the lateral position of the second drive roller relative to the first drive roller to thereby engage with the drive rollers the marginal portions of sheets of different widths.

6. An apparatus as defined in claim 5, wherein the second drive motor is coupled to the drive-roller carriage and movable therewith relative to the first drive roller and first drive motor.

7. An apparatus as defined in claim 1, further comprising:

a control unit electrically coupled to the first and second drive motors and independently controlling at least one of (i) the speeds of rotation, and (ii) and the directions of rotation, of the first and second drive motors.

8. An apparatus as defined in claim 7, further comprising:

a sensor electrically coupled to the control unit and generating electrical signals indicative of the lateral position of a sheet located on the sheet-supporting surface.

9. An apparatus as defined in claim 8, wherein the control unit in response to a sensor signal from the sensor commands the first drive motor and the second drive motor to at least one of (i) rotate the first drive roller and the second drive roller, respectively, at different speeds relative to each other, and (ii) rotate the first drive roller and the second drive roller, respectively, in different directions relative to each other, in order to align the sheet with a feed path extending in the second coordinate direction.

10. An apparatus for plotting on sheets of different widths, comprising:

first means for supporting a sheet;

second means spaced apart from and movable in a first coordinate direction relative to the first means for plotting on the sheet;

third means rotatably mounted on a first shaft and defining an abrasive surface for rotatably engaging a first marginal portion of the sheet and driving the sheet in a second coordinate direction; and fourth means rotatably mounted on a second shaft spaced laterally relative to the third means and defining an abrasive surface for rotatably engaging a second marginal portion of the sheet and further driving the sheet in the second coordinate direction, wherein at least one of the third and fourth means is movable laterally relative to the other for engaging first and second marginal portions of sheets of different widths;

fifth means for rotatably driving the third means to thereby drive the sheet in the second coordinate direction; and sixth means for rotatably driving the fourth means to thereby further drive the sheet in the second coordinate direction;

wherein the fourth means and sixth means are both movable laterally relative to the third means.

11. An apparatus as defined in claim 10, further comprising:

means for pressing the first marginal portion of the sheet into engagement with the abrasive surface of the third means to thereby frictionally engage and drive the sheet in the second coordinate direction; and means for pressing the second marginal portion of the sheet into engagement with the abrasive surface of the fourth means to thereby frictionally engage and further drive the sheet in the second coordinate direction.

12. An apparatus as defined in claim 11, further comprising:

means spaced laterally between the third and fourth means and defining an abrasive surface for engaging a portion of the sheet located between the first and second marginal portions of the sheet and further driving the sheet in the second coordinate direction; and means for pressing the portion of the sheet located between the first and second marginal portions of the sheet against the means spaced laterally between the third and fourth means for further driving the sheet in the second coordinate direction.

13. An apparatus as defined in claim 11, further comprising means for electrically actuating at least one of (i) the means for pressing the first marginal portion of the sheet, and (ii) the means for pressing the second marginal portion of the sheet, between a dis-engaged position with the means for pressing spaced away from the sheet, and an engaged position with the means for pressing engaging the sheet against the respective abrasive surface.

14. An apparatus as defined in claim 10, wherein an elongated aperture is formed adjacent to the first means, the abrasive surface of the third means extends through the aperture for contacting a sheet supported by the first means, and the fourth means is movable laterally through the aperture relative to the third means for engaging the marginal portions of sheets of different widths.

15. An apparatus as defined in claim 10, further comprising:

means extending in the first coordinate direction for guiding the lateral movement of the fourth means relative to the third means.

16. An apparatus as defined in claim 15, wherein the sixth means is supported on the means for guiding the lateral movement of the fourth means, and is movable thereon with the fourth means relative to the third means.

17. An apparatus as defined in claim 10, further comprising:

control means electrically coupled to the fifth means and sixth means for independently controlling at least one of (i) the rotational speeds, and (ii) the rotational directions, of the third means and fourth means, respectively.

18. An apparatus as defined in claim 17, further comprising:

sensor means electrically coupled to the control means for generating electrical signals indicative of the lateral position of a sheet supported by the first means.

19. An apparatus as defined in claim 18, wherein the control means in response to a sensor signal from the sensor means commands the fifth means and the sixth means to at least one of (i) rotate the third means and fourth means, respectively, at different speeds relative to each other, and (ii) rotate the third means and fourth means, respectively, in different directions relative to each other, to align the sheet with a feed path extending in the second coordinate direction.

20. An apparatus as defined in claim 10, further comprising means for controlling at least one of (i) the rotational speeds, and (ii) the rotational directions, of the third means and the fourth means relative to each other for correcting skew error in a sheet supported by the first means.

21. A method for plotting on sheets of different widths on a plotter having a sheet-supporting surface, and a plotting tool spaced apart from and movable in a first coordinate direction relative to the sheet-supporting surface, comprising the following steps:

providing a first drive roller rotatably mounted on a first drive shaft and defining an abrasive surface for engaging a first marginal portion of a sheet and driving the sheet in a second coordinate direction;

providing a second drive roller rotatably mounted on a second drive shaft and defining an abrasive surface for engaging a second marginal portion of the sheet and further driving the sheet in the second coordinate direction;

moving at least one of the (i) the first drive roller and a first drive motor, and (ii) the second drive roller and a second drive motor, in the first coordinate direction relative to the other drive roller and motor to align the first drive roller with the first marginal portion of the sheet and align the second drive roller with the second marginal portion of the sheet;

frictionally-engaging the first and second marginal portions of the sheet with the first and second drive rollers, respectively, and rotatably driving the first and second drive rollers to drive the sheet in the second coordinate direction; and moving the plotting tool in the first coordinate direction over the sheet to create relative movement at the interface of the plotting tool and sheet and thereby plot on the sheet.

22. A method as defined in claim 21, further comprising the following skew-control steps for substantially eliminating skewing of the sheet:

(a) sensing the lateral position of the sheet on the sheet-supporting surface; and (b) at least one of (i) rotatably driving the first and second abrasive drive rollers at different speeds relative to each other, and (ii) rotatably driving the first and second abrasive drive rollers in different rotational directions relative to each other, to align the sheet with a feed path extending in the second coordinate direction.

23. A method as defined in claim 22, further comprising the steps of:

providing a third drive roller defining an abrasive surface for engaging a portion of a sheet located between the first and second marginal portions of the sheet, and further driving the sheet in a second coordinate direction;

providing a pinch roller mounted adjacent to the third drive roller, and movable between an engaged position pressed against the sheet and the third drive roller, and a dis-engaged position spaced away from the sheet and third drive roller;

moving the third pinch roller into its dis-engaged position during the skew-control steps; and moving the third pinch roller into its engaged position upon termination of the skew-control steps and during plotting on the sheet.

24. A method as defined in claim 22, further comprising the steps of:

(a) loading a predetermined length of sheet onto the sheet supporting surface;

(b) performing said skew-control steps during the step of loading the predetermined length of sheet onto the sheet support surface;

(c) terminating the skew-control steps; and (d) plotting on the predetermined length of sheet upon terminating the skew-control steps.

25. A method as defined in claim 24, further comprising the steps of:

(e) successively plotting on a plurality of predetermined lengths of sheet to complete the plot on a sheet; and (e) repeating steps (a) through (d) for each of a plurality of predetermined lengths of sheet until completing the plot on the sheet.

26. A method as defined in claim 24, wherein the step of loading each predetermined length of sheet onto the sheet-supporting surface includes driving the predetermined length of sheet forwardly relative to the sheet-supporting surface in the second coordinate direction, and then rearwardly relative to the sheet-supporting surface in the second coordinate direction.

* * * * *